US006257021B1

(12) United States Patent
Hinton

(10) Patent No.: US 6,257,021 B1
(45) Date of Patent: Jul. 10, 2001

(54) UNIVERSAL DISPOSABLE EARRING RETAINER

(76) Inventor: Joyce Ann Hinton, 3440 Mevel Pl., La Crescenta, CA (US) 91214

( * ) Notice: Subject to any disclaimer, the term of this patent is extended or adjusted under 35 U.S.C. 154(b) by 0 days.

(21) Appl. No.: 09/094,776

(22) Filed: Jun. 15, 1998

(51) Int. Cl.[7] ..... A44C 7/00

(52) U.S. Cl. ..... 63/12; 24/705; 24/706.9

(58) Field of Search ..... 63/12, 14.9, DIG. 1; 24/705, 114, 114.7, 706.9; 428/43

(56) References Cited

U.S. PATENT DOCUMENTS

| | | | | |
|---|---|---|---|---|
| 1,971,216 | * | 8/1934 | Gould | 63/14.3 |
| 3,605,438 | * | 9/1971 | Chalson | 63/29.1 X |
| 4,106,723 | * | 8/1978 | Couture | 242/118.3 |
| 4,214,456 | | 7/1980 | Hannum . | |
| 4,242,886 | | 1/1981 | Tucker . | |
| 4,372,131 | | 2/1983 | Musillo . | |
| 4,630,452 | * | 12/1986 | Connelly et al. | 63/12 |
| 4,771,613 | | 9/1988 | Grier . | |
| 4,829,789 | | 5/1989 | Tsamas . | |
| 4,974,430 | * | 12/1990 | Turner | 63/12 |
| 5,010,686 | * | 4/1991 | Rivest | 47/62 |
| 5,081,853 | * | 1/1992 | Salyer | 63/12 |
| 5,537,841 | * | 7/1996 | Bradvica | 63/12 |
| 5,622,372 | * | 4/1997 | Fujisawa et al. | 277/235 R |
| 5,638,701 | * | 6/1997 | Dempsey | 63/12 |
| 5,769,995 | * | 6/1998 | Greyerbiehl | 156/250 |
| 5,845,378 | * | 12/1998 | Karmeli et al. | 24/705 |
| 6,003,333 | * | 12/1999 | Stevens | 63/12 |

FOREIGN PATENT DOCUMENTS

| | | | | |
|---|---|---|---|---|
| 2519523 | * | 7/1983 | (FR) | 63/12 |

* cited by examiner

*Primary Examiner*—Anthony Knight
*Assistant Examiner*—Andrea Chop
(74) *Attorney, Agent, or Firm*—Philip K. Yu; David J. Arthur

(57) ABSTRACT

An earring retainer comprising an elastic material having a front side and a back side and a scoring or cut for receiving a post of an earring such that the post may puncture the elastic material and is held firmly by friction. The earring retainers are made and used by cutting an elastic material into esthetic shapes, making an axial scoring on each earring retainer from a front side to a back side for each earring retainer to receive an earring post, and then packaging the earring retainers against a backing sheet. By way of example, when made and used in this manner, each earring retainer can be cut into individual esthetic shapes and can be easily peeled away for use by the user.

10 Claims, 4 Drawing Sheets

UNIVERSAL DISPOSABLE EARRING RETAINER

BACKGROUND OF THE INVENTION

This invention relates generally to pierced earrings and, more specifically, to a device for preventing loss of a pierced earring from an ear lobe.

This invention was developed in response to the bothersome problem of finding a quick replacement for lost earring retainers. Often, if one loses an earring retainer, one also loses the earring. If lucky enough to notice the missing retainer before such a loss, the person usually has no alternative to the metal retainer and therefore removes both earrings until a replacement retainer can be retrieved from home, or purchased.

This invention provides a readily available sheet of retainers that are not only easy to slip into a pocket or carry in a purse, but are also an effective "one size fits all" alternative to the metallic retainer.

These and other objects of the invention will be apparent to those skilled in this art from the following detailed description of a preferred embodiment of the invention.

SUMMARY OF THE INVENTION

The invention herein disclosed broadly concerns earring retainers. A referred embodiment of the invention includes a single piece elastic earring retainer which can be carried on a backing sheet. Because of its single piece elastic nature, it is readily suitable for use with a variety of differently sized earring posts and is conveniently portable.

DETAILED DESCRIPTION OF THE PREFERRED EMBODIMENT

Figure 1:
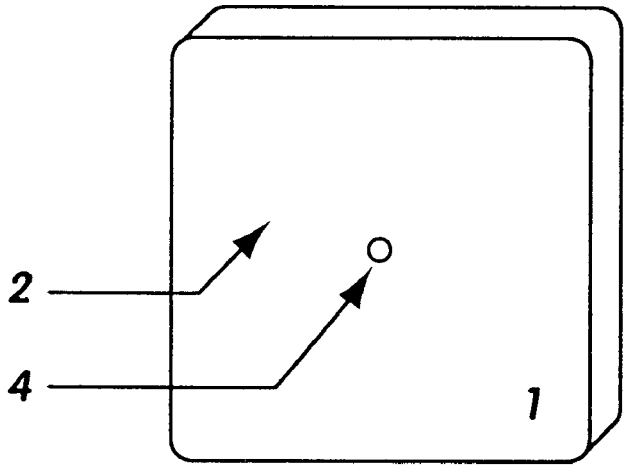
FIG. 1 is a drawing of the front side of one embodiment of an individual earring retainer.
Figure 2:
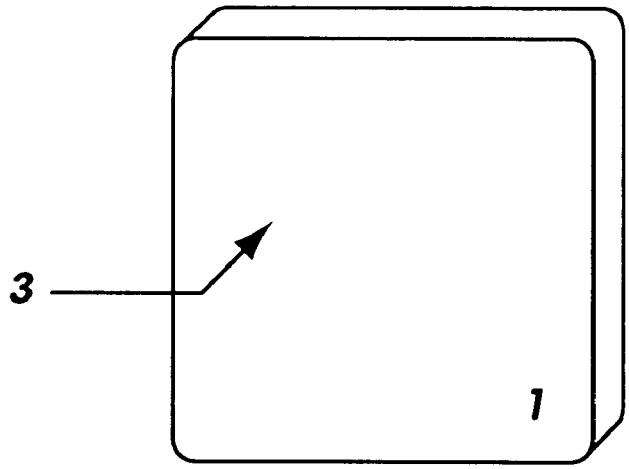
FIG. 2 is a drawing of the back side of the embodiment of the individual earring retainer shown in FIG. 1.
Figure 3:
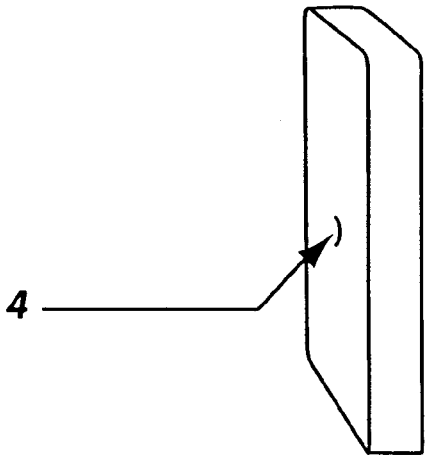
FIG. 3 is a side perspective view of the embodiment of the individual earring retainer shown in FIGS. 1 and 2.

Referring first to FIGS. 1–3, an elastic material 1, is shown, having a front side 2, and a back side 3, and is particularly adapted to be mounted against a human ear. The elastic material 1 is preferably non-metallic. The elastic material may be provided with a scoring 4 extending axially from the front side 2 to the back side 3. Although FIG. 1 shows a scoring 4 that does not penetrate through the elastic material 1, the scoring may penetrate to and through the back side 3. The scoring 4 provides a means for receiving a post of an earring to guide the earring retainer into position directly adjacent the user's ear, such that the post is held firmly against the elastic material. In an alternative embodiment, the scoring 4 may be replaced by a cut, slit, indent, or other physical penetration of the elastic material 1. The elastic material 1 may be cut into aesthetic shapes to form individual earring retainers. The individual earring retainers may be packaged against a backing sheet so that each earring retainer can easily be peeled away. Thus, the elastic material may be cut into individual aesthetic shapes for use as earring retainers on a backing to be peeled away by the user. To use the earring retainer, the user may remove the earring retainer from the backing sheet. An adhesive may be applied for securing the earring retainer to the user's ear.

Figure 4:
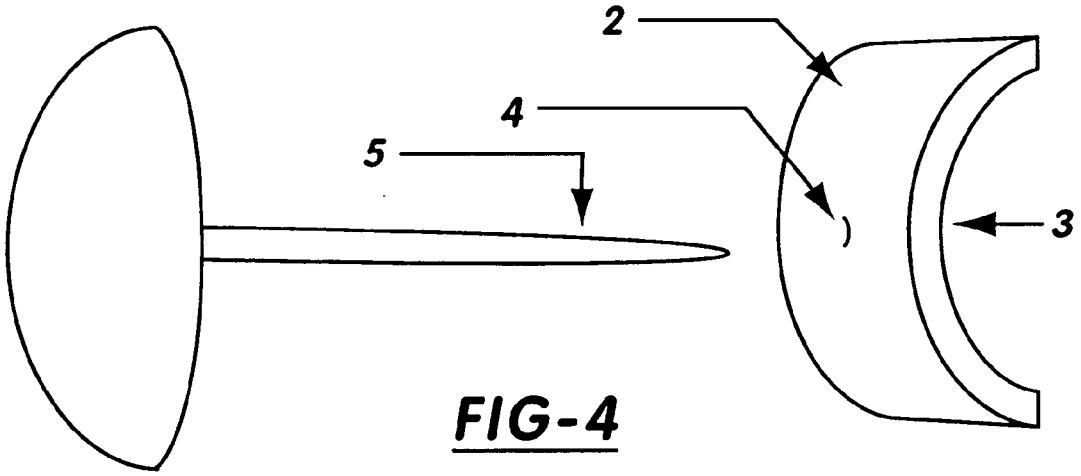
FIG. 4 is a drawing of a second embodiment of an individual earring retainer and an earring having an earring post.
Figure 5:
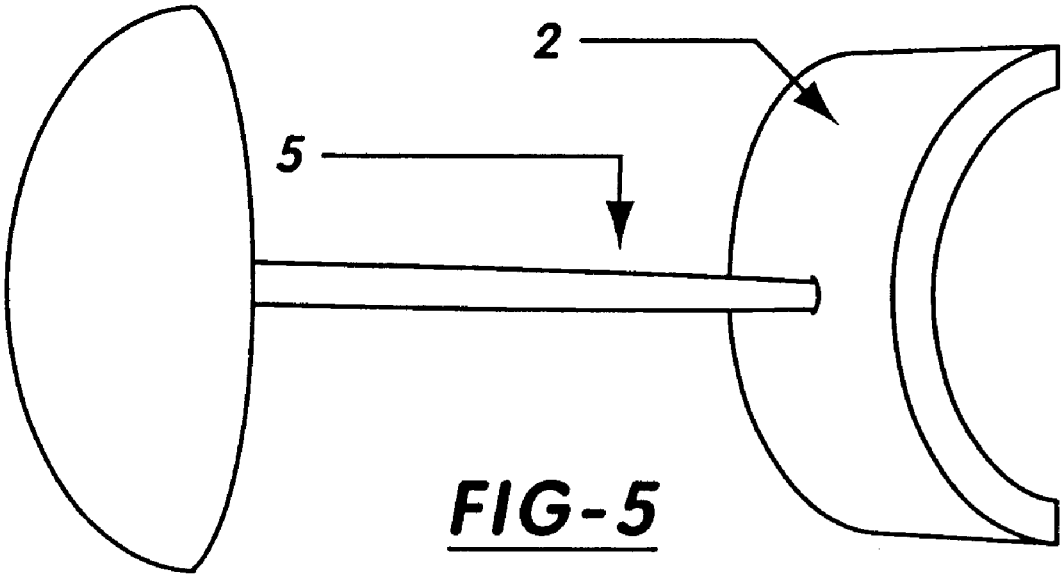
FIG. 5 is a drawing of the second embodiment of the individual earring retainer, showing the earring post being received by and puncturing the earring retainer.
Figure 6:
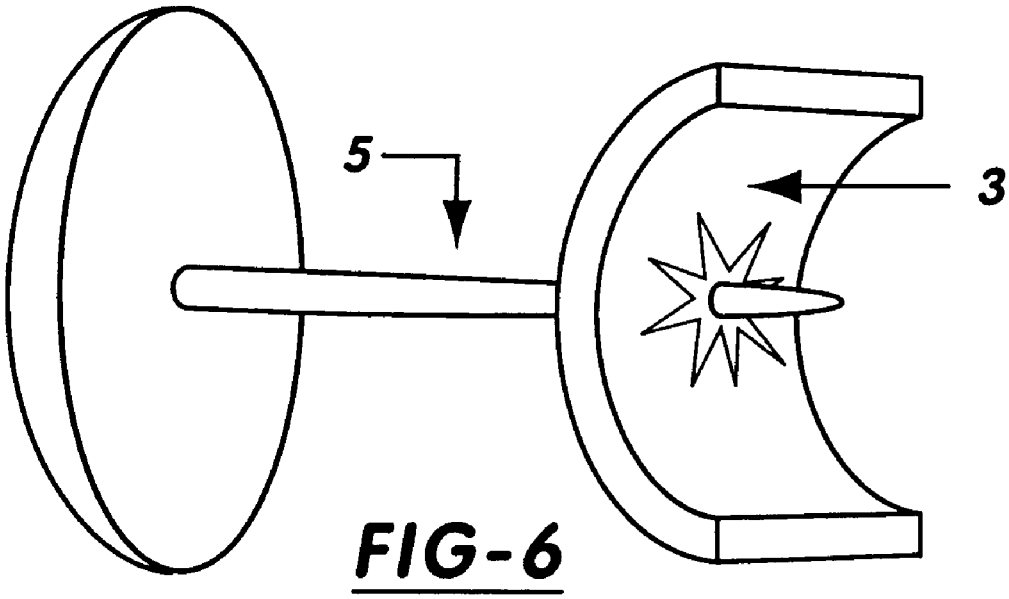
FIG. 6 is a drawing of the second embodiment of the individual earring retainer, showing the earring post received by and puncturing the earring retainer.
Figure 7:
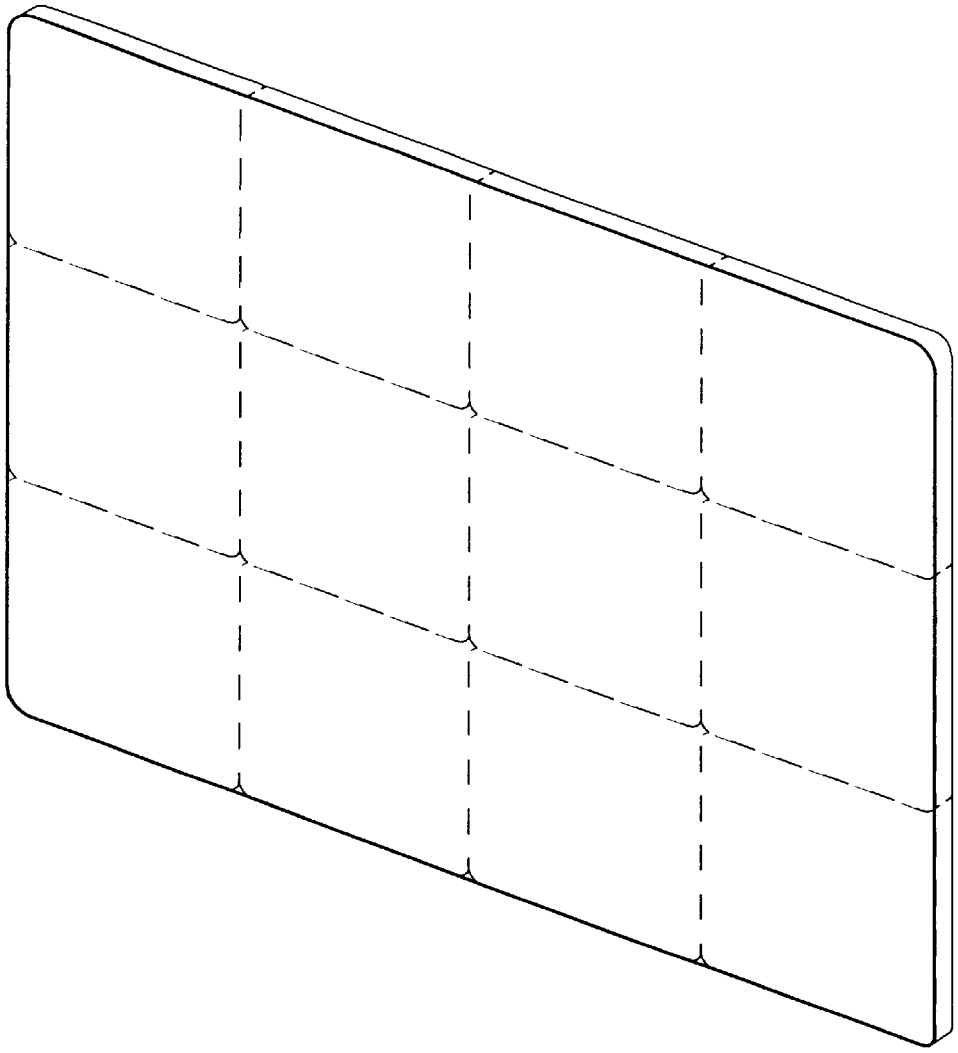
FIG. 7 is a drawing of a sheet of elastic material preformed with a plurality of retainers.
Figure 8:
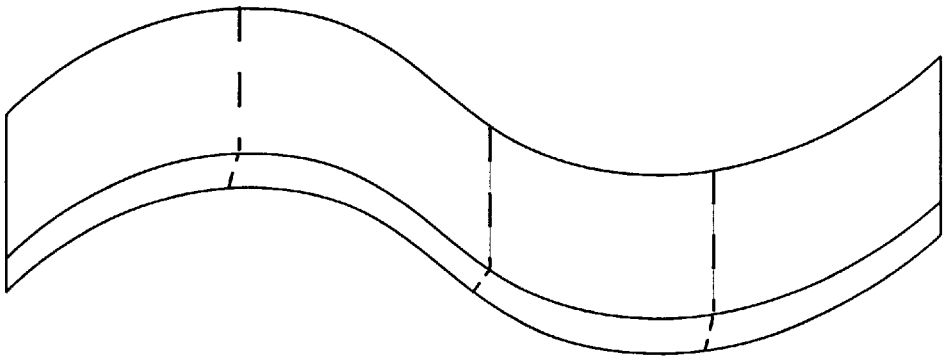
FIG. 8 is a drawing of a strip of elastic material preformed with a plurality of retainers.

Referring to FIGS. 4–6, the elastic material 1 is such that an earring post 5 is allowed to pierce the elastic material 1 and is held firmly. As suggested in FIG. 1, above, the earring post 5 may pass through a scoring, cut, slit, indent, or other physical penetration of the elastic material, such that the post punctures the elastic material and is held firmly by friction. Thus, the scoring 4 (FIG. 1) provides a means for receiving a post of an earring to guide the earring retainer into position directly adjacent the user's ear, further such that the post is held firmly against the elastic material. Thus, in use, the user may remove the earring retainer from a backing sheet, and push the 25 post through the user's ear. The user then inserts the earring post through the earring retainer such that the post is held firmly by the earring retainer. In an alternative embodiment, no physical penetration of the elastic material 1 need be present prior to inserting a post 5, but the post 5 is held firmly once it pierces the elastic material 1.

What is claimed is:

1. An earring and a retainer combination for retaining the earring to a user's earlobe, said earring having a post, the retainer comprising elastic material, without any preformed hole therein, for frictional attachment to said post, said elastic material having a front side and a back side, said front side being adapted to receive said post, said elastic material having no adhesive applied to either side thereof, and having a scoring on the front side of the elastic material, wherein the scoring does not penetrate through the elastic material.

2. The earring and retainer combination of claim 1, wherein the elastic material has an aesthetic shape.

3. The earring and retainer combination of claim 1 wherein the elastic material comprises a single piece of elastic material detached from an integral elastic material pre-formed with a plurality of pieces of elastic material.

4. An earring and a retainer combination for retaining said earring to a user's earlobe, said earring having a post, the retainer comprising elastic material without any preformed hole therein, for frictional attachment to said post, said elastic material having a front side and a back side, said elastic material having no adhesive applied to either side thereof, said front side adapted to receive said post and having a guide on the front side of the elastic material to help directing the post through the elastic material, wherein the guide does not penetrate through the elastic material.

5. The earring and retainer combination of claim 4, wherein the guide comprises a scoring into the front side of the elastic material.

6. The earring and retainer combination of claim 4, wherein the elastic material has an aesthetic shape.

7. The earring and retainer combination of claim 4, wherein the elastic material comprises a single piece of elastic material detached from an integral elastic material pre-formed with a plurality of pieces of elastic material.

8. A method of using an earring retainer for retaining an earring, said earring having a post, the method comprising the steps of:

providing an elastic material having a front side and a back side for frictional attachment to said post, said elastic material having no adhesive applied to either side thereof, said elastic material having no preformed hole therein; and inserting said earring post through the elastic material from the front side to the back side, thereby creating an opening through the elastic material.

9. The method of claim 8, wherein the step of inserting an earring post through the elastic material additionally comprises, prior to the inserting step, the step of aligning the earring post with a guide on the front side of the elastic material.

10. The method of claim 9, wherein the step of aligning the earring post with a guide comprises aligning the earring post with a scoring on the front side of the elastic material.

* * * * *